US008632361B2

(12) United States Patent
Chen

(10) Patent No.: US 8,632,361 B2
(45) Date of Patent: Jan. 21, 2014

(54) ELECTRICAL CONNECTOR

(75) Inventor: Hsin-chih Chen, Taoyuan (TW)

(73) Assignee: Oupiin Electronic (Kunshan) Co., Ltd., Kunshan (CN)

( * ) Notice: Subject to any disclaimer, the term of this patent is extended or adjusted under 35 U.S.C. 154(b) by 30 days.

(21) Appl. No.: 13/528,882

(22) Filed: Jun. 21, 2012

(65) Prior Publication Data

US 2013/0052876 A1 Feb. 28, 2013

(30) Foreign Application Priority Data

Aug. 24, 2011 (CN) ..... 2011 2 0314141 U

(51) Int. Cl.
*H01R 13/648* (2006.01)

(52) U.S. Cl.
USPC ..... 439/607.07

(58) Field of Classification Search
USPC ..... 436/79, 607.07
See application file for complete search history.

(56) References Cited

U.S. PATENT DOCUMENTS 4,846,727 A * 7/1989 Glover et al. ..... 439/607.07
6,764,316 B1 * 7/2004 Yu ..... 439/79
6,827,590 B2 * 12/2004 Huss et al. ..... 439/79
6,890,215 B2 * 5/2005 Lang et al. ..... 439/607.35
7,059,872 B2 * 6/2006 Tanaka et al. ..... 439/79
7,708,567 B2 * 5/2010 Tokunaga ..... 439/79
8,469,745 B2 * 6/2013 Davis et al. ..... 439/607.07
2005/0851109 * 2/2001 Huang et al. ..... 439/79
2003/0176086 A1 * 9/2003 Ogawa ..... 439/79
2009/0035964 A1 * 2/2009 Yamamoto et al. ..... 439/79
2010/0144203 A1 * 6/2010 Glover et al. ..... 439/607.07

* cited by examiner

*Primary Examiner* — Neil Abrams
*Assistant Examiner* — Phuongchi T Nguyen
(74) *Attorney, Agent, or Firm* — Mark M. Friedman

(57) ABSTRACT

An electrical connector is provided in the present invention, including a plurality of electrical terminal groups, a metal housing, a metal positioning seat and a fixing member. The metal housing has a plurality of terminal-receiving grooves, each of which can accommodate two electrical terminal groups. A contact end of the electrical terminal group extends forward within the metal housing, and a connection end of the electrical terminal group extends downward out of the metal housing. The fixing member has a first bending sheet and a second bending sheet, which are perpendicular to each other and respectively connected to the metal housing and the metal positioning seat for fixing the metal positioning seat to the metal housing. The electrical connector of the present invention uses the metal housing to enhance the electromagnetic shielding effect, have a better heat dissipation efficacy and improve the stability of the connection structure.

5 Claims, 4 Drawing Sheets

ELECTRICAL CONNECTOR

BACKGROUND OF THE INVENTION

1. Field of the Invention

The present invention relates to an electrical connector, and more particularly to an electrical connector for transmitting a high speed signal.

2. Description of the Prior Art

An electrical connector has become a basic element of electronic equipment, and can electrically connect and transmit the signal between devices and devices, elements and elements, system and system. For example, a pair of connectors may connect the circuits of two PCBs together to transmit the high speed electronic signal therebetween.

Generally, the electrical connector must have a good shielding effect, a better heat dissipation efficacy and a stable structure design to improve the precision of the signal transmission, thereby assuring the normal operation of the electronic equipment. At present, the common electrical connector generally comprises three basic elements, such as an electrical terminal, a plastic housing and a shielding shell. The electrical terminal is used to transmit the signal, the plastic housing is used to load the electrical terminal, and the main function of the shielding shell is to provide a shielding function, dissipate the heat and protect the internal components of the electrical connector. For example, the shielding shell disposes a grounding structure to realize the shielding function, and the shielding shell can further cover the surrounding of the plastic housing to realize the object of protecting the plastic housing and the electrical terminal.

But because the electrical connector is more widely used to transmit the high speed electronic signal, the electromagnetic shielding becomes more and more important. However, the assembly mode of the plastic housing and the shielding shell in the prior art will produce an assembly clearance, which is easy to result in the problem of the electromagnetic leakage and the bad heat dissipation efficacy, so it is not suitable to be applied to the electrical connector of transmitting the high speed electronic signal. Moreover, the number of the electrical terminals used in this type of the electrical connector also sharply increases, so the loading power and the structure stability of the whole electrical connector also must increase, for enhancing the safety in use.

Hence, it is necessary to provide a new electrical connector, which can employ a metal housing instead of a combination structure of the plastic housing and the shielding shell, for overcoming above defects.

BRIEF SUMMARY OF THE INVENTION

A primary object of the present invention is to provide an electrical connector, in which electrical terminal groups are mounted in a metal housing, for enhancing the electromagnetic shielding effect, have a better heat dissipation efficacy and improve the stability of the electrical connector.

The other object and the advantage of the present invention may be further understood from the technical features disclosed by the present invention.

To achieve the aforementioned object or other objects of the present invention, the present invention adopts the following technical solution. An electrical connector comprises a plurality of independent electrical terminal groups, a metal housing, a metal positioning seat and a fixing member. Each of the electrical terminal groups includes an electrical terminal and an insulating body enclosing the electrical terminal. The electrical terminal enclosed by the insulating body only exposes a horizontal contact end and a vertical connection end. The metal housing includes a housing front portion, a housing rear portion and a plurality of terminal-receiving grooves passing through the housing front portion and the housing rear portion. A front surface of the housing front portion forms a plurality of openings, and the housing rear portion forms a step-shaped structure. Each of the terminal-receiving grooves is capable of accommodating two of the electrical terminal groups. The contact end of the electrical terminal of each electrical terminal group extends forward into the opening of the housing front portion, and the connection end thereof extends downward from the housing rear portion. A top surface of the metal positioning seat forms a step-shaped structure to match with the step-shaped structure of the housing rear portion. The metal positioning seat forms a plurality of terminal-passing grooves. When the metal positioning seat is assembled on the metal housing, the connection end of the electrical terminal of each electrical terminal group is capable of passing through the corresponding terminal-passing groove and extends out of a bottom surface of the metal positioning seat. The fixing member has a first bending sheet and a second bending sheet, which are perpendicular to each other. The first bending sheet is fixed on a top surface of the metal housing, and the second bending sheet is fixed on a rear surface of the metal positioning seat.

The top surface of the metal housing forms a plurality of first protrusion blocks. The first bending sheet of the fixing member forms a plurality of retaining slots. The retaining slots are matched with the first protrusion blocks to fix the first bending sheet on the metal housing.

The rear surface of the metal positioning seat forms a plurality of second protrusion blocks. The second bending sheet of the fixing member forms a plurality of positioning holes. The positioning holes are matched with the second protrusion blocks to fix the second bending sheet on the metal positioning seat.

Two sides of the metal housing respectively form, a guiding post extending forward.

Two sides of the metal positioning seat respectively form a positioning post extending downward.

Comparing with the prior art, the electrical connector of the present invention employs the metal housing instead of a combination structure of the plastic housing and the shielding shell of the prior art, thereby enhancing the electromagnetic shielding effect, having a better heat dissipation efficacy and improving the stability of the electrical connector.

DETAILED DESCRIPTION OF THE PREFERRED EMBODIMENTS

For more clearly and easily understanding the object, the feature and the advantage of the present invention, the following text will take a preferred embodiment of the present invention with reference to the accompanying drawings for detail description as follows. Moreover, directional terms mentioned in the present invention, such as “top”, “bottom”, "front", "back", "left", "right", "inside", "outside", "side" etc., are only used with reference to the orientation of the accompanying drawings. Therefore, the used directional terms are intended to illustrate, but not to limit, the present invention.

Figure 1:
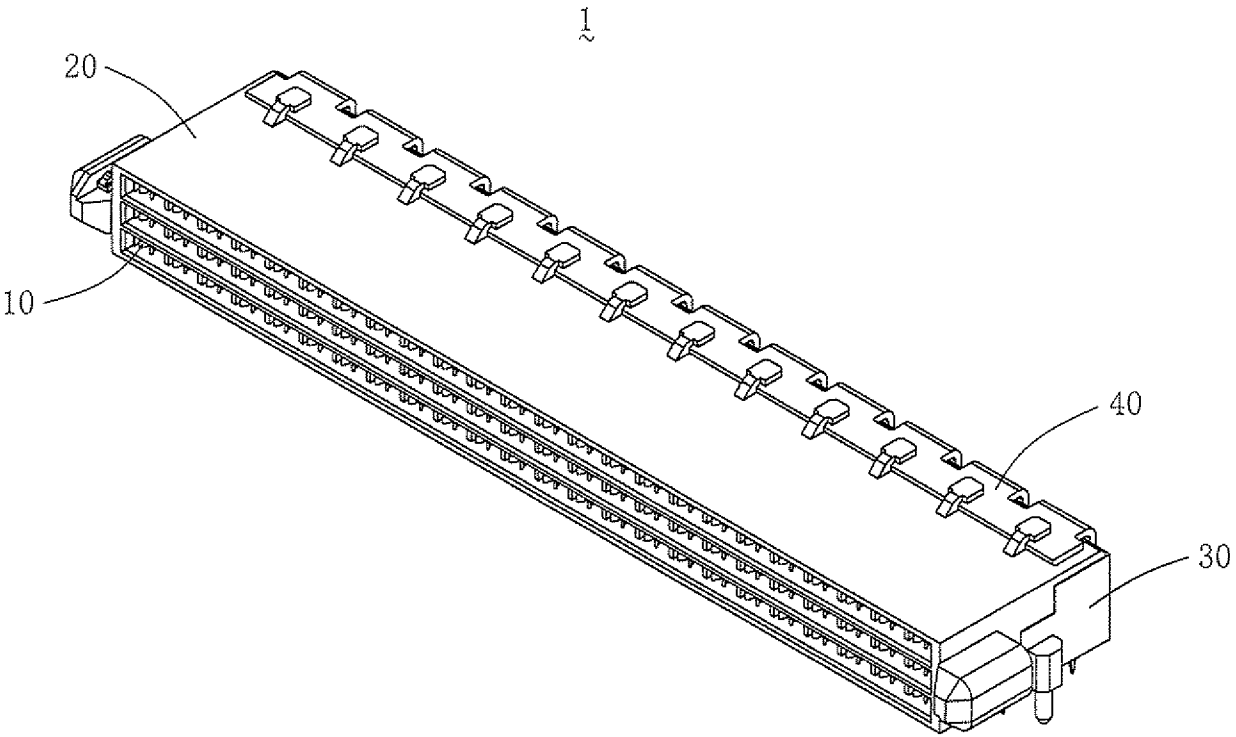
FIG. 1 is a perspective view of an electrical connector of the present invention.
Figure 2:
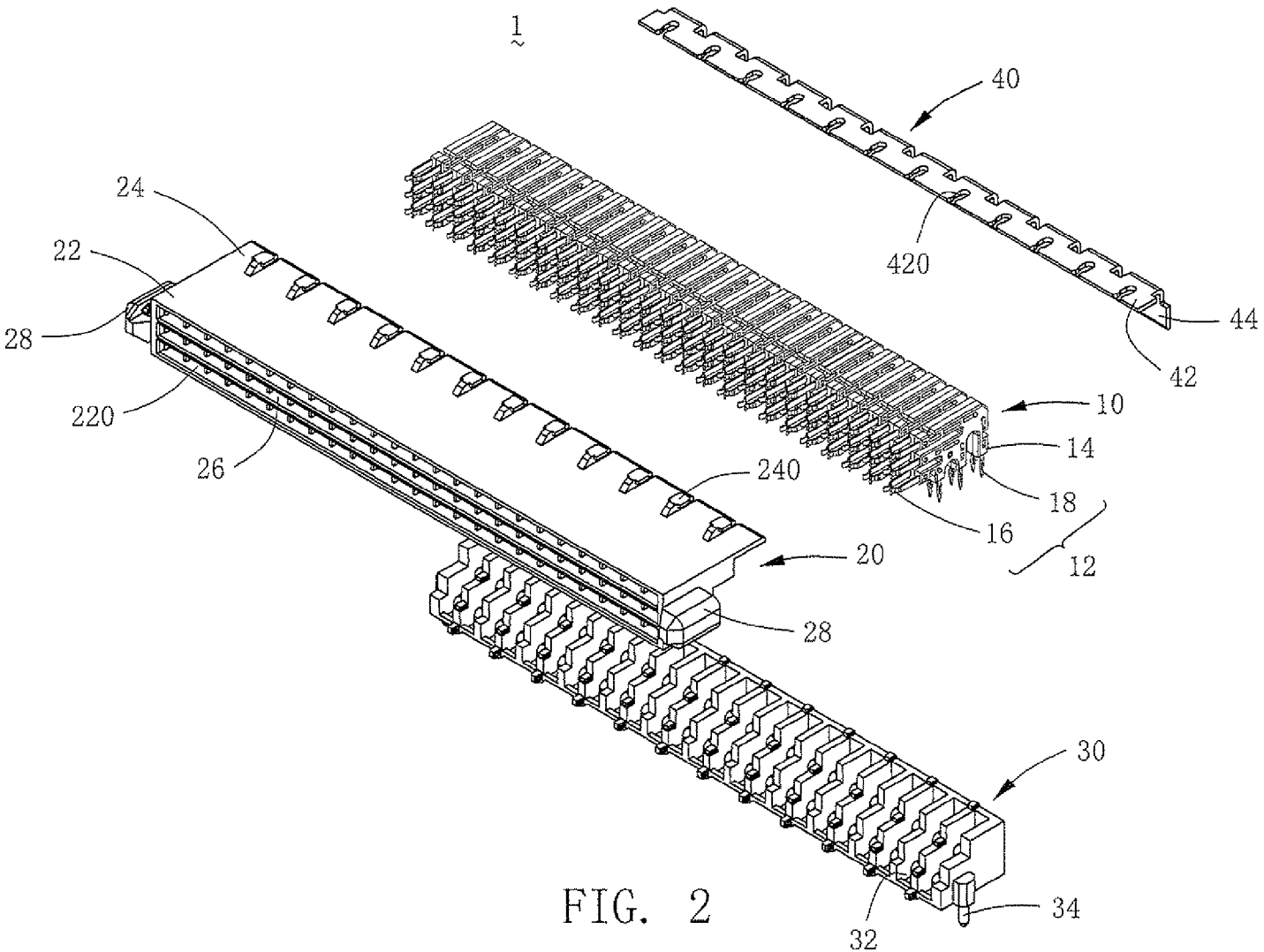
FIG. 2 is an exploded view of the electrical connector of the present invention.
Figure 3:
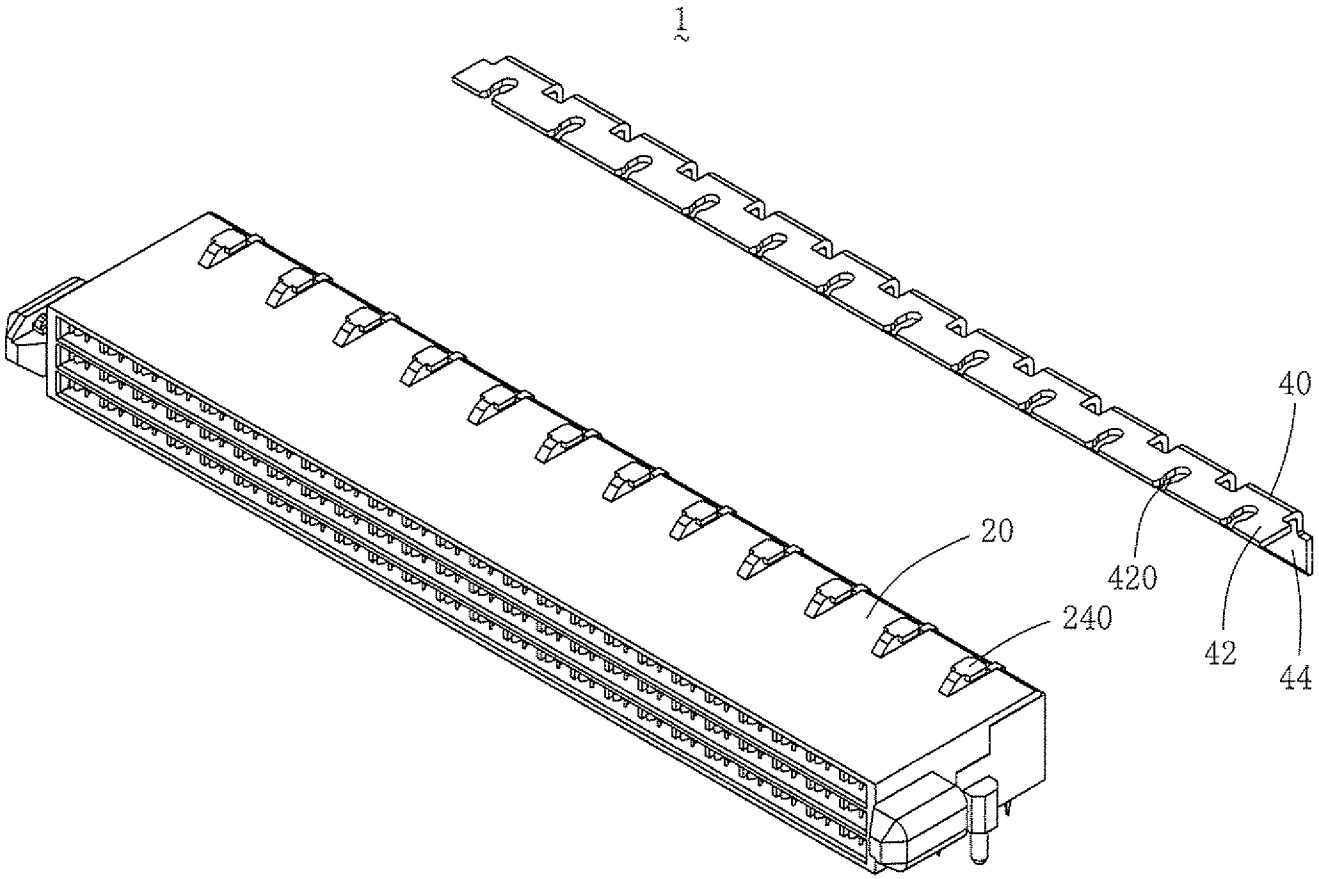
FIG. 3 is a partial exploded view of the electrical connector of the present invention.
Figure 4:
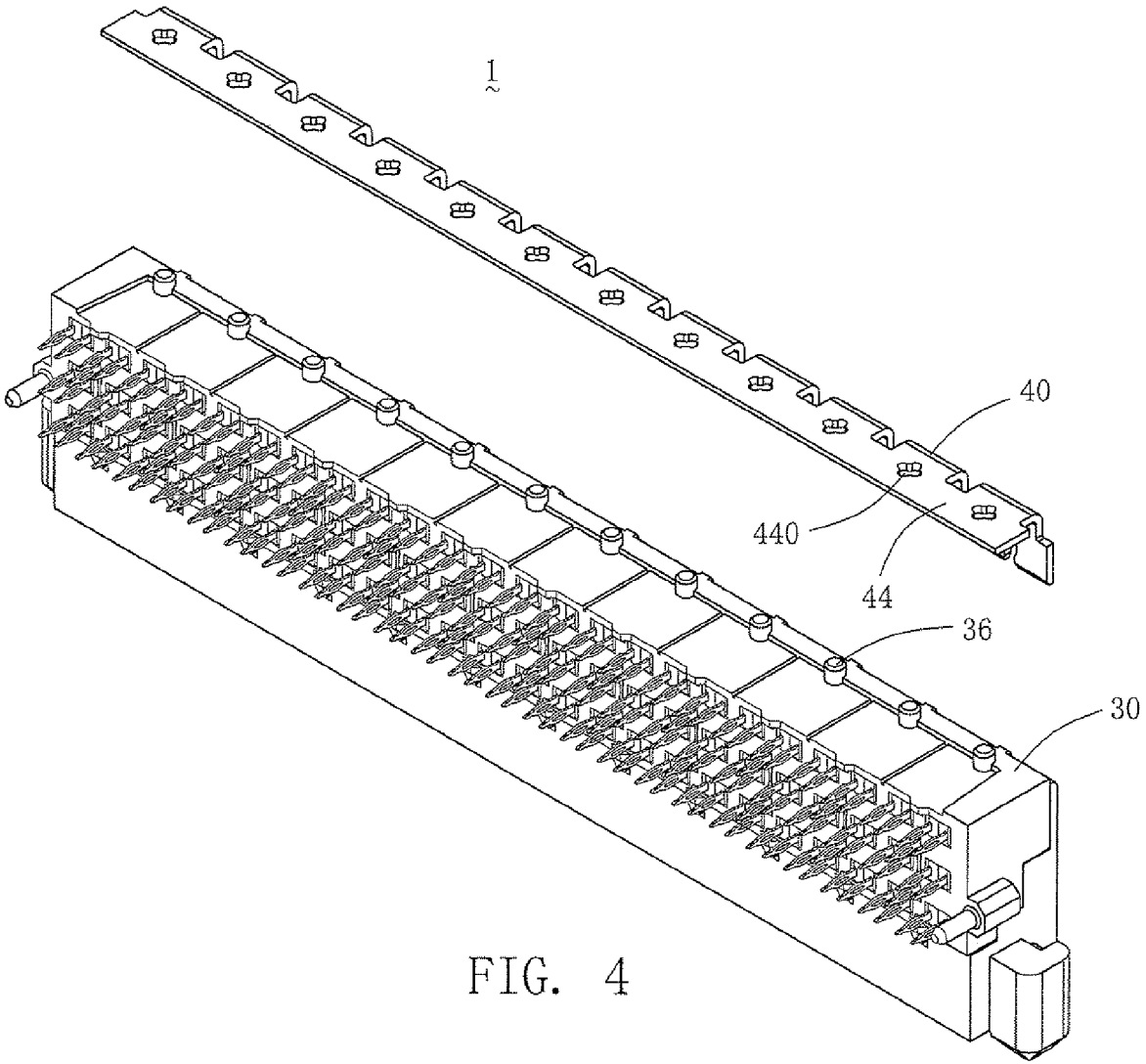
FIG. 4 is a partial exploded view of another direction of the electrical connector of the present invention.

Please refer to FIGS. 1 to 4, FIG. 1 is a perspective view of an electrical connector 1 of the present invention, FIG. 2 is an exploded view of the electrical connector 1 of the present invention, FIG. 3 is a partial exploded view of the electrical connector 1 of the present invention, and FIG. 4 is a partial exploded view of another direction of the electrical connector 1 of the present invention. The electrical connector 1 of the present invention comprises a plurality of independent electrical terminal groups 10, a metal housing 20, a metal positioning seat 30 and a fixing member 40, wherein these electrical terminal groups 10 are used to transmit signal, the metal housing 20 is used to load these electrical terminal groups 10, the metal positioning seat 30 can fix these electrical terminal groups 10, and the fixing member 40 can fix the metal positioning seat 30 to the metal housing 20.

Please refer to FIG. 2, each of the electrical terminal groups 10 includes an electrical terminal 12 and an insulating body 14 enclosing the electrical terminal 12. The electrical terminal 12 enclosed by the insulating body 14 only exposes a horizontal contact end 16 and a vertical connection end 18. The contact end 16 may be connected to a complementary connector (not shown in drawings), and the connection end 18 need be soldered or press fit on an outer circuit board (not shown in drawings).

Please refer to FIG. 2, the metal housing 20 is a metal casting, which includes a housing front portion 22, a housing rear portion 24 and a plurality of terminal-receiving grooves 26 passing through the housing front portion 22 and the housing rear portion 24. A front surface of the housing front portion 22 forms a plurality of openings 220, and the housing rear portion 24 forms a step-shaped structure. Each of the terminal-receiving grooves 26 is capable of accommodating two electrical terminal groups 10. Namely, each two of these electrical terminal groups 10 are received in one terminal-receiving groove 26. The contact end 16 of each electrical terminal 12 extends forward within the opening 220 of the housing front portion 22, and the connection end 18 of the electrical terminal 12 extends downward from the housing rear portion 24. In one embodiment, two sides of the metal housing 20 respectively form a guiding post 28, which protrudes forward and is used to guide the complementary connector to the electrical connector 1.

Please refer to FIG. 2, the metal positioning seat 30 is also a metal casting, a top surface of which forms a step-shaped structure to match with the step-shaped structure of the housing rear portion 24. The metal positioning seat 30 forms a plurality of vertical terminal-passing grooves 32. When the metal positioning seat 30 is assembled on the metal housing 20, the connection end 18 of each electrical terminal 12 can pass through the corresponding terminal-passing groove 32 of the metal positioning seat 30 and extends out of a bottom surface of the metal positioning seat 30. In one embodiment, two sides of the metal positioning seat 30 respectively form a positioning post 34, which extends downward and is used to retain the electrical connector 1 on the outer circuit board.

Please refer to FIG. 3 and FIG. 4, the fixing member 40 has a first bending sheet 42 and a second bending sheet 44, which are perpendicular to each other. The first bending sheet 42 is fixed on a top surface of the metal housing 20, and the second bending sheet 44 is fixed on a rear surface of the metal positioning seat 30.

In one embodiment, as shown in FIG. 2 and FIG. 3, the top surface of the metal housing 20 forms a plurality of first protrusion blocks 240. The first bending sheet 42 of the fixing member 40 forms a plurality of retaining slots 420. The retaining slots 420 are matched with the first protrusion blocks 240 to fix the first bending sheet 42 on the metal housing 20.

In one embodiment, as shown in FIG. 4, the rear surface of the metal positioning seat 30 forms a plurality of second protrusion blocks 36. The second bending sheet 44 of the fixing member 40 forms a plurality of positioning holes 440. The positioning holes 440 are matched with the second protrusion blocks 36 to fix the second bending sheet 44 on the metal positioning seat 30.

In conclusion, the electrical connector 1 of the present invention employs the metal housing 20 instead of a combination structure of the plastic housing and the shielding shell of the prior art, thereby enhancing the electromagnetic shielding effect, having a better heat dissipation efficacy and improving the stability of the electrical connector 1.

The present invention has been illustrated by the above embodiments, but the above embodiments only are used as examples for implementing the present invention. It must need to be pointed out that the exposed embodiments cannot limit the scope of the present invention. Oppositely, the modification and equivalent structures included within the spirit and scope of the appended claims are also included within the scope of the present invention.

What is claimed is:

1. An electrical connector, comprising:

a plurality of independent electrical terminal groups, each of which including an electrical terminal and an insulating body enclosing the electrical terminal, the electrical terminal enclosed by the insulating body only exposing a horizontal contact end and a vertical connection end;

a metal housing, including a housing front portion, a housing rear portion and a plurality of terminal-receiving grooves passing through the housing front portion and the housing rear portion, wherein a front surface of the housing front portion forming a plurality of openings, the housing rear portion forming a step-shaped structure, each of the terminal-receiving grooves being capable of accommodating two of the electrical terminal groups, the contact end of the electrical terminal of each electrical terminal group extending forward into the opening of the housing front portion, and the connection end thereof extending downward from the housing rear portion;

a metal positioning seat, a top surface of which forming a step-shaped structure to match with the step-shaped structure of the housing rear portion, the metal positioning seat forming a plurality of terminal-passing grooves, when the metal positioning seat being assembled on the metal housing, the connection end of the electrical terminal of each electrical terminal group being capable of passing through the corresponding terminal-passing groove and extending out of a bottom surface of the metal positioning seat; and a fixing member, having a first bending sheet and a second bending sheet, which are perpendicular to each other, the first bending sheet being fixed on a top surface of the metal housing, and the second bending sheet being fixed on a rear surface of the metal positioning seat.

2. The electrical connector as claimed in claim 1, wherein two sides of the metal housing respectively form a guiding post extending forward.

3. The electrical connector as claimed in claim 1, wherein two sides of the metal positioning seat respectively form a positioning post extending downward.

4. The electrical connector as claimed in claim 1, wherein the top surface of the metal housing forms a plurality of first protrusion blocks, the first bending sheet of the fixing member forms a plurality of retaining slots, and the retaining slots are matched with the first protrusion blocks to fix the first bending sheet on the metal housing.

5. The electrical connector as claimed in claim 4, wherein the rear surface of the metal positioning seat forms a plurality of second protrusion blocks, the second bending sheet of the fixing member forms a plurality of positioning holes, and the positioning holes are matched with the second protrusion blocks to fix the second bending sheet on the metal positioning seat.

* * * * *